US011130650B2

(12) United States Patent
Gerhardt et al.

(10) Patent No.: US 11,130,650 B2
(45) Date of Patent: Sep. 28, 2021

(54) WEB-LIKE INTERLEAVING SHEET MATERIAL AT A CUTTING ZONE

(71) Applicant: Weber Maschinenbau GmbH Breidenbach, Breidenbach (DE)

(72) Inventors: Markus Gerhardt, Biedenkopf (DE); Andreas Stöwer, Schmallenberg (DE); Michael Knauf, Amöneburg-Mardorf (DE); Jens Krüger, Haiger (DE); Marvin Schäfer, Haiger (DE)

(73) Assignee: Weber Maschinenbau GmbH Breidenbach

( * ) Notice: Subject to any disclaimer, the term of this patent is extended or adjusted under 35 U.S.C. 154(b) by 0 days.

(21) Appl. No.: 16/809,645

(22) Filed: Mar. 5, 2020

(65) Prior Publication Data

US 2020/0290840 A1 Sep. 17, 2020

(30) Foreign Application Priority Data

Mar. 13, 2019 (DE) ..... 102019106369.8

(51) Int. Cl.
*B65H 39/06* (2006.01)
*B65H 35/00* (2006.01)
*B65H 39/16* (2006.01)

(52) U.S. Cl.
CPC ..... *B65H 35/0086* (2013.01); *B65H 39/06* (2013.01); *B65H 39/16* (2013.01)

(58) Field of Classification Search
CPC .... B65H 35/0086; B65H 39/06; B65H 39/16; B65H 20/32; B65B 41/12; B26D 7/27
(Continued)

(56) References Cited

U.S. PATENT DOCUMENTS 3,848,757 A 11/1974 Jordan
5,803,392 A * 9/1998 Laney ..... B65H 20/32 226/118.1

(Continued)

FOREIGN PATENT DOCUMENTS

DE 2117839 A 10/1972
DE 102017118934 A1 1/2019

(Continued)

OTHER PUBLICATIONS

Official Communication from the German Patent Office for related German Patent Application No. 102019106369.8; dated Feb. 28, 2020; 2 pages.

(Continued)

*Primary Examiner* — Leslie A Nicholson, III
(74) *Attorney, Agent, or Firm* — Dickinson Wright PLLC

(57) ABSTRACT

The invention relates to an apparatus for providing web-like interleaving sheet material on one track or on multiple tracks at a cutting zone in which products supplied on one track or multiple tracks are cut into slices and interleaving sheets are introduced that are cut off from the provided interleaving sheet material in the cutting zone, having a removal device that is configured to remove the material web from a material store, and having a loop store in which the material web forms a loop having a loop portion at the incoming side and a loop portion at the outgoing side, wherein the loop store provides a reception space for the loop whose one side forms a support for the one loop portion and whose side opposite the support forms a boundary for the other loop portion.

20 Claims, 5 Drawing Sheets

Figure 1:
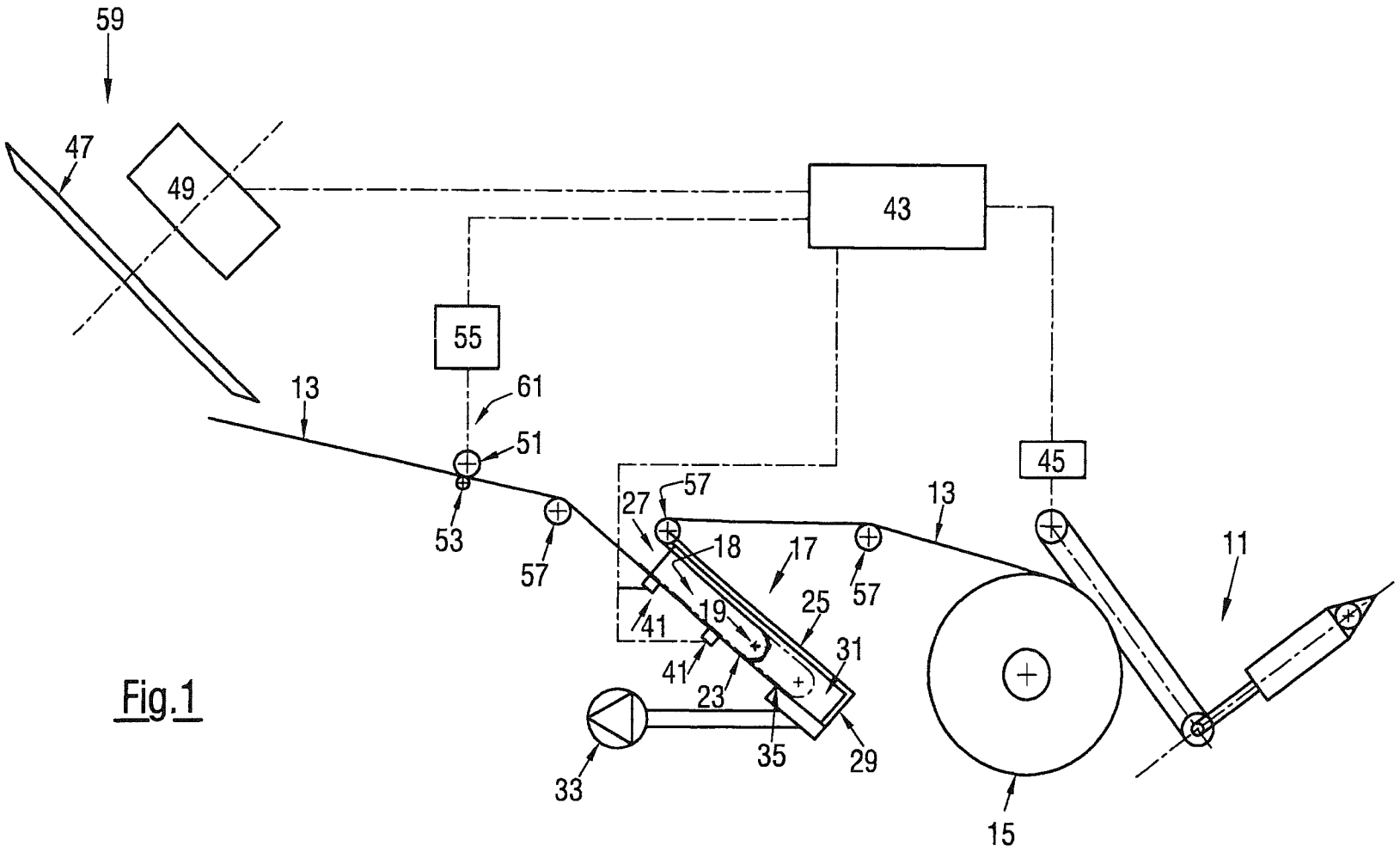

(58) Field of Classification Search
USPC ..... 270/52.09
See application file for complete search history.

(56) References Cited

U.S. PATENT DOCUMENTS

| | | | | |
|---|---|---|---|---|
| 6,164,583 | A * | 12/2000 | Spatafora | B65H 23/042 242/331.3 |
| 10,647,013 | B2 * | 5/2020 | Einloft-Velte | B26D 1/565 |
| 2002/0179767 | A1 | 12/2002 | Rapparini | |
| 2009/0159631 | A1 * | 6/2009 | DePoi | B65H 20/32 226/8 |

FOREIGN PATENT DOCUMENTS

| | | | |
|---|---|---|---|
| DE | 102017118921 | A1 | 2/2019 |
| EP | 2671829 | A2 | 5/2013 |
| EP | 3444212 | A1 | 7/2018 |
| GB | 718419 | A | 11/1954 |

OTHER PUBLICATIONS

Official Communication from the European Patent Office for Related EP Application No. 20160952.6; dated Aug. 10, 2020.

* cited by examiner

WEB-LIKE INTERLEAVING SHEET MATERIAL AT A CUTTING ZONE

The invention relates to an apparatus for providing web-like interleaving sheet material at a cutting zone in which supplied products are cut into slices and interleaving sheets are introduced that are cut off from the provided interleaving sheet material in the cutting zone.

Slices cut off from the products in the cutting zone can consequently be provided with the interleaving sheets introduced into the cutting zone. In this respect, either interleaving sheets can e.g. be respectively introduced between two directly consecutive slices or interleaving sheets can be respectively introduced beneath a slice and thus between said slice and a support surface of said slice. On the formation of portions from a plurality of slices, for example, a respective interleaving sheet is then located beneath the bottommost slice of a portion. Such a function, that is also called an underleaver function, does not, however, preclude that in the formation of portions a respective interleaving sheet is not only disposed beneath the bottommost slice, but also one or more interleaving sheets are respectively also introduced between two consecutive slices within the portion. Irrespective of whether an underleaver function is provided or not, a respective interleaving sheet can generally be introduced within a portion either between every pair of directly consecutive slices or only between one or more pairs of directly consecutive slices, e.g. between every nth pair, where n>1.

Such apparatus are generally known in the field of slicing food products and are also called interleavers or underleavers. In this respect—as mentioned above—an interleaver can also carry out an underleaver function and vice versa. The present disclosure therefore not only applies to the interleavers primarily explained here or to the providing of interleaving sheets or interleaving sheet material in each case between two directly consecutive slices, but also to so-called "underleavers" that serve to place a sheet beneath products. Such an underleaving sheet feed ensures that at least the total lower sides of the products do not lie directly on a support surface, for example of a conveying device. When in the following only the term "interleaver" is respectively used, the respective statements and the respective disclosure—where meaningful—also apply to an "underleaver". As already mentioned, one and the same apparatus for providing interleaving sheet material or interleaving sheets can exert both an interleaver function and an underleaver function in dependence on the respective application, i.e. an interleaver is simultaneously also an underleaver, and vice versa, within the framework of this disclosure.

The invention also relates to an apparatus for slicing food products having a product feed that feeds products to be sliced to a slicing region in which a cutting blade moves in a rotating and/or revolving manner to cut the supplied products into slices and having an interleaver and/or underleaver in accordance with the invention.

Such cutting apparatus are also called slicers or high speed slicers, the latter against the background that food products of bar shape or loaf shape can e.g. be sliced at high cutting speeds of several hundred to some thousand slices per minute by such machines. In a number of applications, stacked or overlapping portions are, for example, formed from the cut off slices falling onto a support surface formed e.g. by a portioning belt. An interleaver, for example, serves to introduce interleaving sheets between directly consecutive slices of a portion so that the slices can later be more easily separated from one another. Paper or a plastic film serves as the material for the interleaving sheets, for example.

Ever higher demands are also made on the interleavers and/or underleavers in accordance with the progress in the development of cutting machines, in particular with respect to speed, accuracy, and versatility. Known interleaver and/or underleaver concepts that generally produce satisfactory results frequently no longer satisfy these increased demands.

There is consequently a need for an improved interleaver and/or underleaver technology, in particular in the field of slicing food products by means of high speed slicers. Multi-track and individual-track interleaver and underleaver operation is particularly the main focus.

One problem with the known interleavers and/or underleavers is that the expulsion of the material web into the cutting zone is a highly dynamic process that is the more difficult to handle, the greater the cutting speed is. This highly dynamic expulsion must therefore where possible be decoupled from the removal of the material web from the relatively sluggish material supply so that a sufficiently large material web length is available at all times outside the material store and the material to be expelled does not have to be removed directly from the material store such as a material roll.

It is known to combat this problem in that a zone is provided in the interleaver in which the material web forms a loop. A decoupling of the expulsion of the material web into the cutting zone from the removal of the material web from the sluggish material store can thus admittedly be achieved, but a loop formation that is difficult to control frequently impairs the interleaver operation with common interleavers.

It is the object of the invention to improve an interleaver such that a hindrance-free provision of web-like interleaving sheet material at a cutting zone is ensured and in particular to ensure a controlled loop formation.

The object is satisfied by the features of the independent claims.

The apparatus in accordance with the invention enables a single track or multi-track providing of web-like interleaving sheet material at a cutting zone and comprises a removal device that is configured for a removal of the material web from a material store and a loop store in which the material web forms a loop having a loop portion at the incoming side and a loop portion at the outgoing side, wherein the loop store provides a reception space for the loop whose one side forms a support for the one loop portion and whose side disposed opposite the support forms a boundary for the other loop portion.

In this respect, depending on the orientation of the reception space, either the loop portion at the outgoing side or at the incoming side can extend over the support. The reception space can furthermore be laterally open or closed.

As mentioned above, the loop formation permits a decoupling of the highly dynamic expulsion of the interleaving sheet material into the cutting zone from the removal of the material web from the relatively sluggish material store. It is thereby ensured that the respective web length required in the cutting zone can be removed almost without delay and thus any tensions and uncontrolled force transfers in the material web during the acceleration can be avoided. Due to the at least partly supporting guidance of the loop, the loop formation can furthermore be controlled particularly simply and a fluttering of the material web in the machine space can be suppressed by the bounding of the loop in the loop store at both sides by support and boundary. This is in particular of great advantage with a multi-track interleaver operation since a contact and disruption or even intertwining of material webs running next to one another resulting from a fluttering of the material web can be avoided. The web guidance in the loop store can furthermore be designed in the apparatus in accordance with the invention such that the space requirements of the interleaver at or in the slicer can be minimized.

In accordance with a preferred embodiment, the reception space has an opening at least for the exit of the loop portion at the outgoing side and an end disposed lower than the opening, with a plane extending through the opening and the end extending at an incline with respect to the horizontal, in particular including an angle with the horizontal in the range from 15° to 75°, preferably from 30° to 60°, and in particular preferably from 40° to 50°.

Such an inclined arrangement of the reception space in accordance with this embodiment enables a particularly space saving integration of an interleaver in a slicer or a separate interleaver module associated with the slicer. The end of the reception space is here in particular defined in that it determines the length of the reception space effective for the loop formation. The extent of the support and/or boundary of the reception space between the opening and the end can be either planar or curved. The loop portion at the incoming side can furthermore enter into the reception space both likewise through the opening and through an aperture offset downwardly or upwardly with respect to the opening.

In accordance with a further embodiment, both the support and the boundary each have an opening zone at the opening and an end zone at the end, with both a plane extending through the opening zone and the end zone of the support and a plane extending through the opening zone and end zone of the boundary each extending at an incline with respect to the horizontal, in particular including an angle with the horizontal in the range from 15° to 75°, preferably from 30° to 60°, and in particular preferably from 40° to 50°.

Provision can furthermore be made that the support provides a planar support surface for the loop portion and/or that the boundary provides a planar contact surface for the loop portion.

In accordance with a further embodiment, the support and the boundary can extend at least approximately in parallel with one another in the longitudinal direction of the reception space.

In accordance with a further embodiment, the spacing between the support and the boundary at a respective position in the longitudinal direction of the reception space can define a clearance of the reception space, with the ratio between the smallest clearance of the reception space and the greatest clearance of the reception space being greater than 0.8, in particular when not taking an opening of the reception space into account. Provision can be made here that the opening is designed as considerably narrower than the remaining reception space, that is has a much smaller clearance, which enables a particularly controlled introduction of the loop into the reception space and reduces a fluttering of the material web to a minimum, in particular in the opening zone.

In accordance with a particularly preferred embodiment, the spacing between the support and the boundary at a respective position in the longitudinal direction of the reception space can define a clearance of the reception space, with the ratio between the greatest clearance of the reception space and the length of the reception space effective for the loop formation amounting to less than 0.5 or less than 0.3 or less than 0.1. Such a flat design of the reception space ensures an ideal loop formation and loop control and simultaneously minimizes the construction space required.

The clearance of the reception space in its longitudinal direction can furthermore be at least substantially constant.

In accordance with a preferred embodiment, a clearance of the reception space that is at least substantially constant in the longitudinal direction or the greatest clearance of the reception space can be in the range from 10 mm to 60 mm and preferably in the range from 25 mm to 45 mm.

The reception space can comprise lateral guides for the loop. In this respect, these guides can e.g. be formed as walls, but also as grids or other constructions permitting a guiding of the loop.

Provision can furthermore be made that the reception space is closed at at least one side, preferably at both sides. This increases the robustness of the reception space and permits a particularly ordered design of the web guidance. This design furthermore permits the use of vacuum to form the loop or at least to support the loop formation.

In accordance with a particularly preferred embodiment, the reception space can be formed with multiple tracks. The interleaver in accordance with the invention can hereby be used in conjunction with a multi-track slicing of food products.

The reception space preferably includes at least one dividing member extending in the longitudinal direction of the reception space to separate loops of material webs introduced on multiple tracks from one another.

The reception space can thus consequently be divided into a plurality of part spaces that each represent a separate reception space for the loop of the material web of the respective track. The loop formation of each track thus takes place in a controlled manner and disruptions of an interleaver operated on multiple tracks due to a disordered web guidance in the loop store can be avoided. A particularly space saving operation of a multi-track interleaver is furthermore thus made possible since an interaction of the individual material webs among one another in the loop store is avoided by the dividing members and the material webs can thus be guided as close as maximally possible to one another.

The dividing member can furthermore be adjustable in the transverse direction. This makes it possible to guide material webs of different widths through the loop store and thus to meet the demands of different products cut in the cutting zone with respect to the size of the interleaver material provided.

Provision can furthermore be made that the dividing member is attached to the support of the reception space. The dividing member can thus be positioned with a removed boundary, which accelerates and simplifies both the setting to the required widths and the placing of the loops into the reception space since the loops do not have to be laboriously threaded through a comparatively small opening of the reception space. Alternatively, the dividing members can also be attached to the boundary or a respective part of the dividing members can be attached to the support and the other part to the boundary.

In accordance with an embodiment, provision can be made that the boundary is formed by a removable cover. In this design, the reception space is particularly easily accessible and a fast and simple cleaning of the components is made possible. In addition, a loop can be simply placed into the reception space with a removed cover and does not have to be threaded through a comparatively small opening of the reception space.

In accordance with a preferred embodiment, the boundary can be displaceable relative to the support. The length of the reception space can thus be varied by displacing the boundary and a maximum possible loop size can in particular be selected and set.

The boundary can furthermore be closed.

In accordance with a preferred embodiment, the boundary can be transparent. The loop formation can thus be monitored at all times and also efficiently in operation through the transparent boundary so that any disruptions can be recognized and eliminated particularly fast. In this respect, the boundary can, for example, be produced form antistatic plexiglass, with other materials also being able to be provided.

In accordance with a particularly preferred embodiment, the reception space can have a suction zone for the loop that communicates with a vacuum source to act on an outer side of the loop in the sense of a loop size increase. In comparison with a passive, e.g. gravitational, loop formation, it can be monitored better by this active loop formation and the size of the loop can be selected and adapted. This makes it possible to adapt the loop size as the non-sluggish material store that serves the provision of the material web for highly dynamic expulsion into the cutting zone to the respective demands that result, for example, from the product size and the cutting frequency. This can in particular be of high relevance in multi-track interleaver operation since the demands with respect to the material or the amount thereof to be expelled may vary in different tracks.

One or more suction apertures opening into the suction zone can be provided at at least one side of the reception space, in particular in the region of an end of the reception space, via which suction apertures the vacuum source communicates with the suction zone.

In accordance with a preferred embodiment, the reception space can be formed with multiple tracks, with at least two tracks, preferably all the tracks, having a suction zone for the respective loop and communicating with a common vacuum source to act on an outer side of the respective loop in the sense of an loop size increase. It is therefore not necessary to attach individual track suction devices with interleavers operated with multiple tracks. It has furthermore been shown that an individual track operation of a single suction apparatus is also not necessary, but the desire individual track monitoring via the loop formation can rather already be achieved with a single suction apparatus that develops the same nominal suction effect at each track. The suction device can thereby be configured particularly simply and the number of components and the space requirements for the suction apparatus are minimized.

In accordance with an embodiment, a braking apparatus for the material web, in particular for the loop portion at the outgoing side, is integrated in the loop store. It is hereby ensured that the material web is tensioned in a controlled manner at all times. The braking device preferably acts on the loop portion at the outgoing side.

The braking apparatus can preferably comprise a surface of the reception space at the outgoing side. In this respect, the surface at the outgoing side can be part of the support or of the boundary of the reception space depending on the orientation of the reception space. It is ensured by the development of the braking effect on the loop at a surface at the outgoing side that the forces arising on the feed of the interleaves material into the cutting zone is transferred in a controlled manner to the material web, in particular to the portion of the loop at the incoming size, and to the part of the material web running into the loop store and a fluttering of the material web, in particular in conjunction with a suction effect developed by a vacuum force for the loop formation, is suppressed.

In accordance with an embodiment, the surface at the outgoing side can be formed as air permeable and can preferably be provided with one or more suction apertures.

The surface at the outgoing side can furthermore communicate with a vacuum source. It can, but does not have to, communicate with a vacuum source as described above for sucking the loop into the reception space or can be identical to it.

In accordance with a further embodiment, a device for determining a measure for the size of the loop can be integrated in the loop store.

The device can comprise at least one sensor that acts in a surface of the reception space at the outgoing side or at the incoming side.

In accordance with an embodiment, the sensor can be a contact sensor or a vacuum sensor. In this respect, a contact sensor reacts to a contact with the material web and can, for example, be capacitively, inductively, electromechanically, and/or electrostatically active, while a vacuum sensor responds to a presence of the material web at the location of the sensor producing a vacuum.

The device preferably comprises a plurality of sensors arranged distributed in the longitudinal direction of the surface at the outgoing side. This makes it possible to obtain information on the instantaneous loop size that is as exact and as highly resolved as possible and to adapt the loop size as required. Provision can thus be made, for example, to set the loop size to a determined desired size before the start of the feed of the interleaver material into the cutting apparatus or to vary the loop size if it reaches a predefined minimum or maximum during operation.

In accordance with a preferred embodiment, a control device can be provided that is configured to provide a predefined desired loop size in the reception space that is preferably determined from one or more parameters of a respective cutting program before the start of the slicing of the products by controlling the removal device while taking account of the respective actual loop size determined by the device. The desired loop size can here be calculated automatically from e.g. the cutting speed and the sheet length.

The control device can be configured to vary the loop size in individual tracks in a multi-track operation and to implement desired loop sizes for individual tracks.

The control device can particularly advantageously be configured first to instigate a winding of the material web onto the material roll on the machine start by controlling the removal device and to stop it when the loop size has reached a predefined minimum that can be recognized by one or more sensors in the opening zone. The control device can thereupon cause the removal device to remove the material web and to convey it into the loop store so that the loop reaches the application-relevant desired size recognized by one or more sensors, whereupon the feed of the interleaver material into the cutting zone by means of a conveying device can be started by the control device. This permits a controlled preparation of the interleaver for the highly dynamic material feed and already ensures a regulated operating process from the start of the slicing process. It is furthermore ensured that the loop length is known to the system at all times and that the defined desired loop length was actually reached before the start of the slicing process.

Protection is also independently claimed for this procedure on the machine start, that is in the preparation of the interleaver for the actual slicing operation.

The control device can be configured to carry out this preparation of the interleaver at individual tracks on a multi-track operation.

The invention moreover relates to an apparatus for a single-track or multi-track provision of web-like interleaving sheet material at a cutting zone in which products supplied in one track or in multiple tracks are cut into slices and in which interleaving sheets are introduced that are cut off from the provided interleaving sheet material in the cutting zone, having a removal device that is configured for a removal of the material web from a material store and having a loop store in which the material web forms a loop having a loop portion at the incoming side and having a loop portion at the outgoing side, wherein the loop store has a boundary for the one loop portion and a boundary for the other loop portion, wherein the two boundaries are arranged spaced apart from one another while forming a reception space for the loop, and wherein the spacing between the two boundaries at a respective position in the longitudinal direction of the reception space defines a clearance of the reception space, and wherein the ratio between the largest clearance of the reception space and the length of the reception space effective for the loop formation amounts to less than 0.5 or less than 0.3 or less than 0.1.

Such an areal design of the reception space of the loop makes it possible to ensure the desired control of the loop formation in a special manner and to form the reception space in a particularly space saving manner. In this respect, both boundaries can in principle be oriented in any desired angles with the horizontal adapted to the respective demands and can e.g. extend in parallel with one another in the vertical direction.

This apparatus represents an independent subject of the present disclosure for which protection is also independently claimed.

The invention further relates to an apparatus for a single-track or multi-track slicing of food products, in particular to a high speed slicer, having a product supply that supplies products to be sliced in single tracks or in multiple tracks to a cutting zone in which a cutting blade moves in a rotating and/or revolving manner to cut the supplied products into slices, and having an apparatus for providing web-like interleaving sheet material in accordance with any one of the embodiments described above, wherein a common control device is preferably provided that is configured to coordinate the slicing of the products and the provision of the interleaving sheet material.

This apparatus also represents an independent subject of the present disclosure for which protection is also independently claimed.

Figure 2:
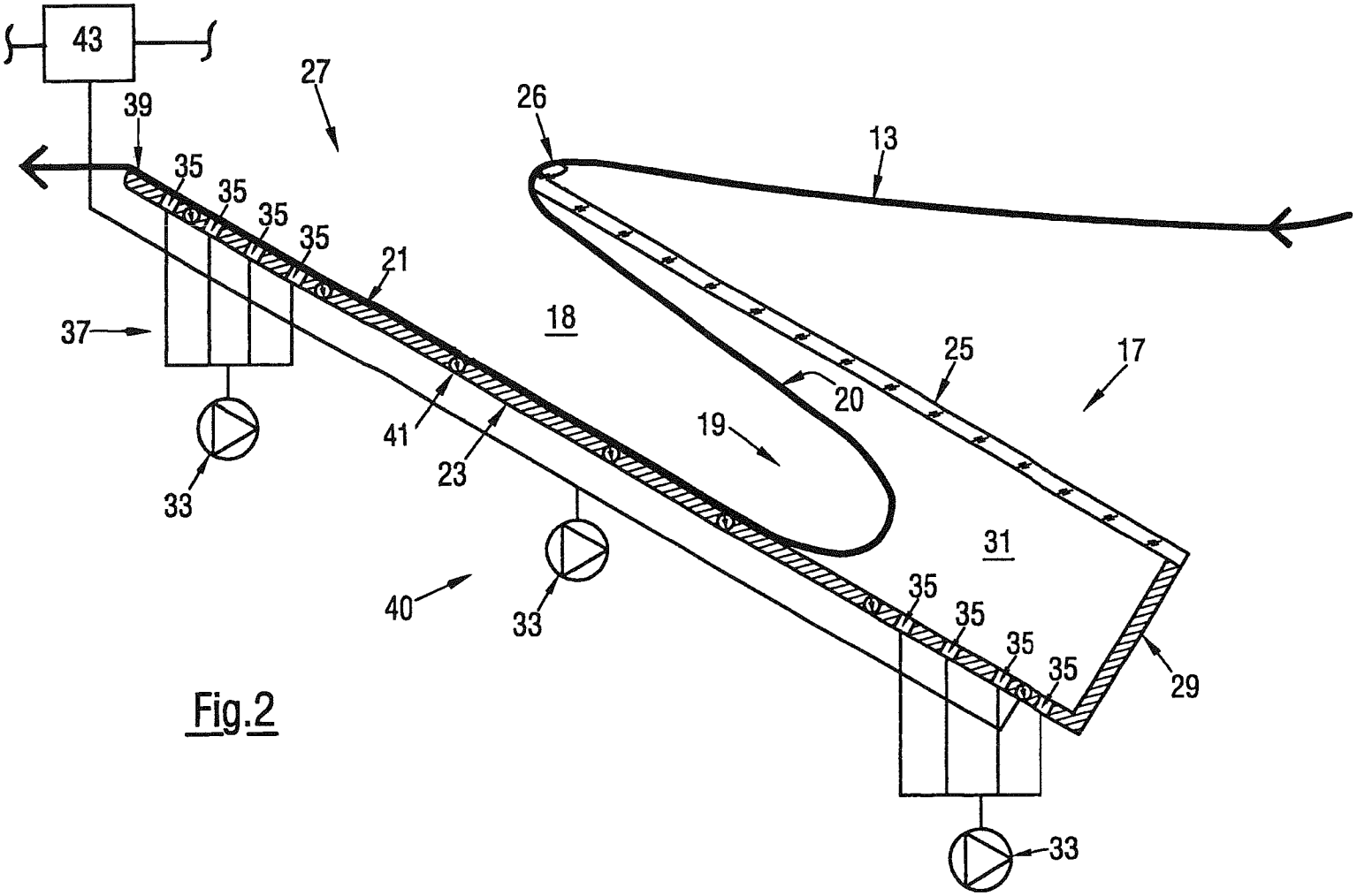
Figure 3:
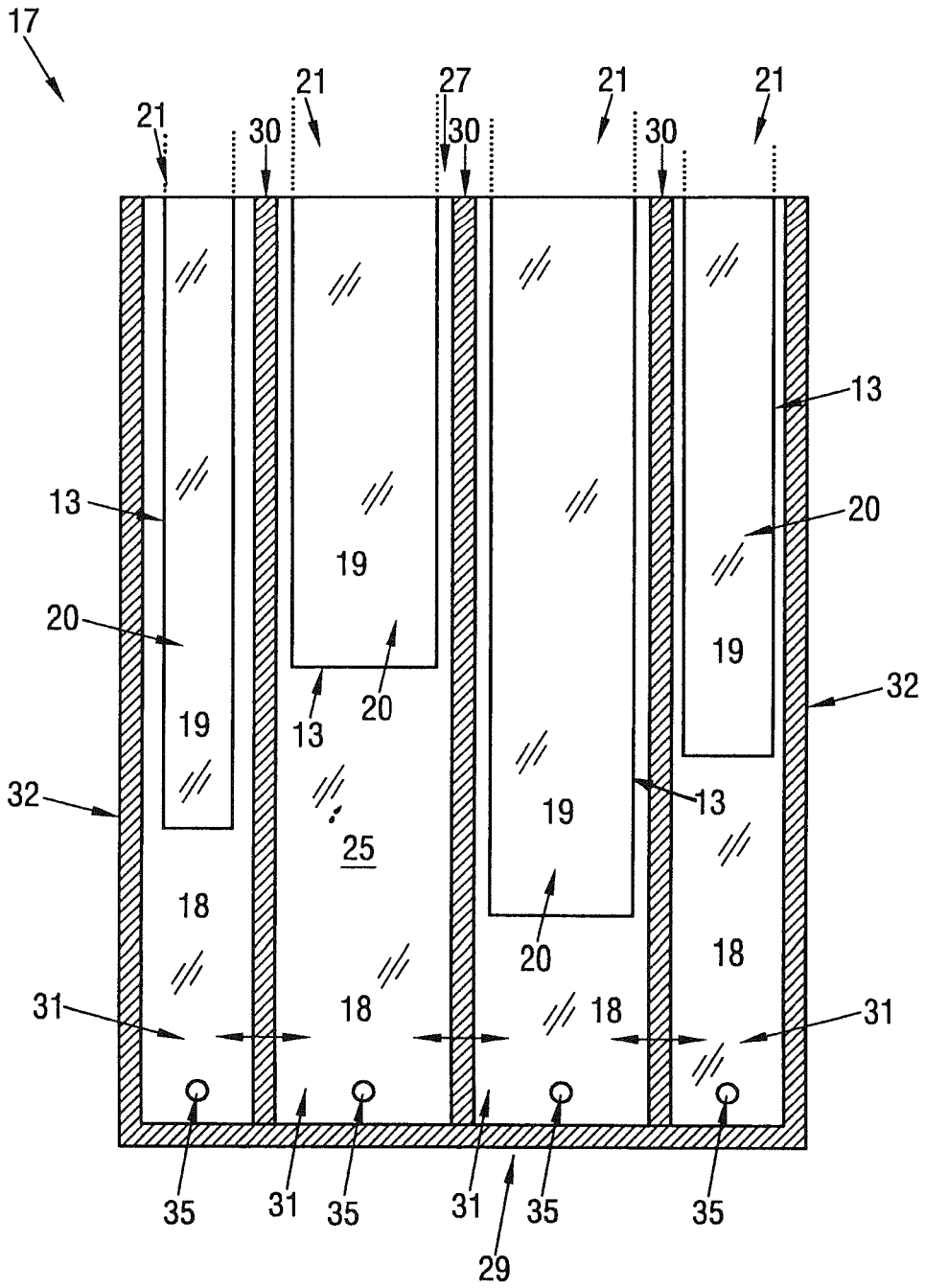
Figure 4:
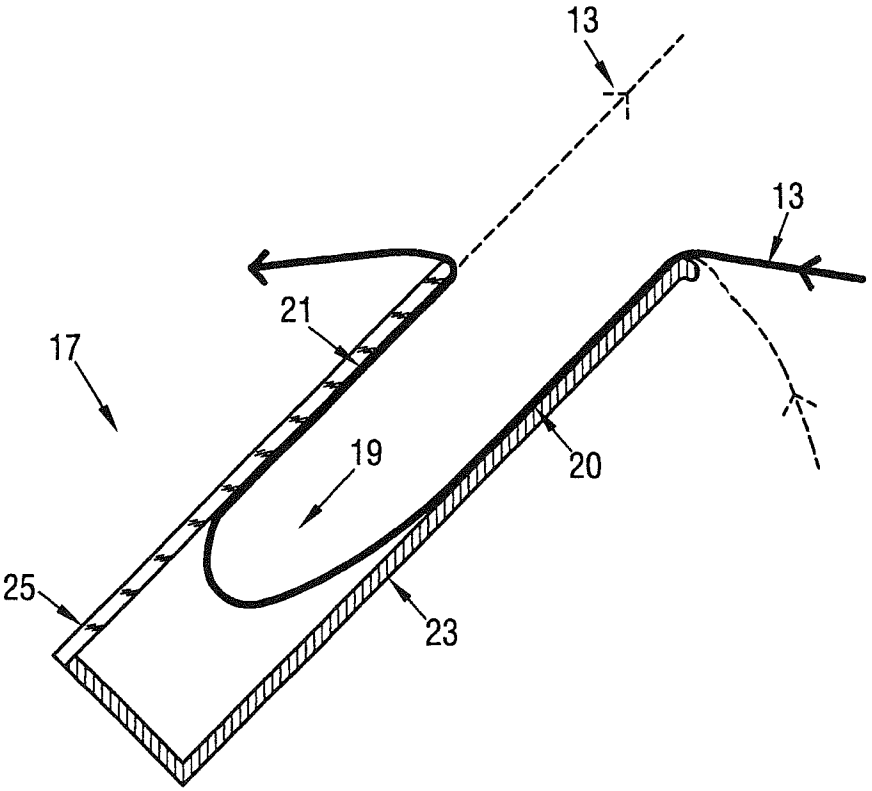
Figure 5:
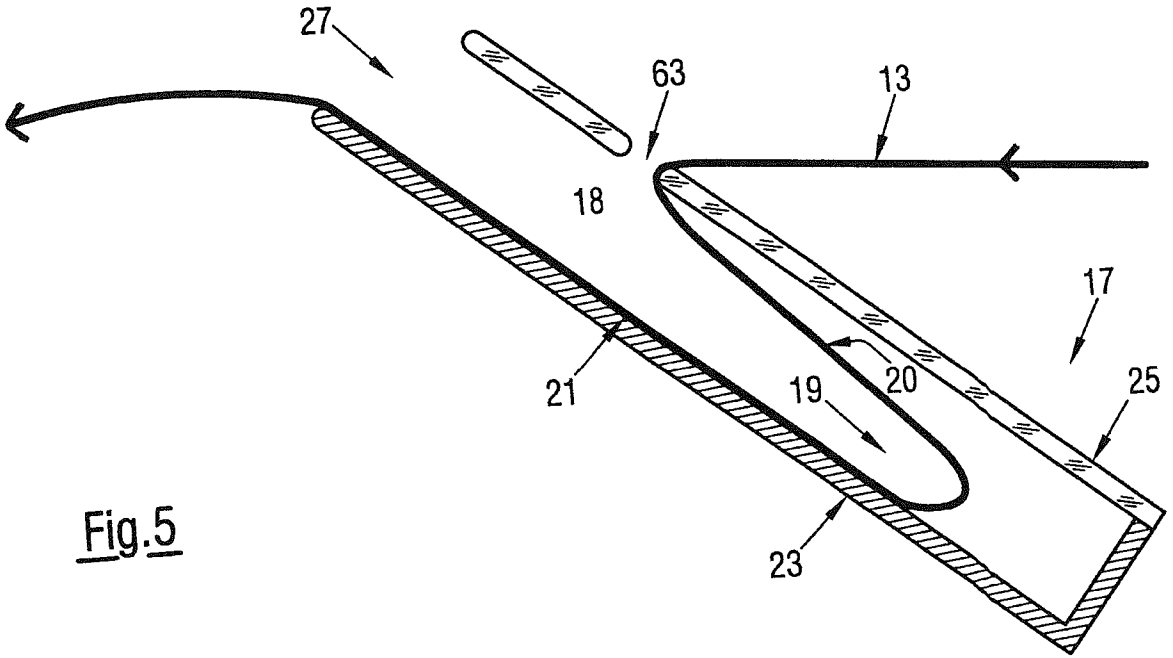

The invention will be described in the following by way of example with reference to the drawings. There are shown:

FIG. 1 schematically, a side view of a slicer, having an interleaver in accordance with an embodiment of the invention;

FIG. 2 a schematic side view of a loop store of an interleaver in accordance with the invention;

FIG. 3 a view from above of an embodiment of a loop store having a reception space for an interleaver in accordance with the invention operated on multiple tracks; and FIGS. 4 and 5 schematically in each case an exemplary embodiment of a loop store having a reception space of an interleaver in accordance with the invention.

FIG. 1 shows a schematic side view, not to scale, of a high speed slicer, that is of an apparatus for slicing food products such as sausage, meat, or cheese, in conjunction with an interleaver. In this respect, both the high speed slicer and the interleaver can each be operated on one track or on multiple tracks.

Products, not shown, provided on one track or on multiple tracks, are cut into slices in a cutting zone 59 of the high speed slicer by a cutting blade 47 that is operated via a drive 49. The cutting blade 47 can, for example, be a so-called scythe-like blade or spiral blade that has a cutting edge extending in scythe or spiral form and that only rotates about a blade axis, not shown. The cutting blade 47 can furthermore be configured e.g. as a so-called circular blade that has a circular cutting edge and rotates about its own blade edge and additionally revolves around in a planetary motion about an axis extending offset in parallel with the blade axis.

The embodiment of an interleaves in accordance with the invention shown schematically here has a removal device 11 that serves for the removal of a material web 13 from a material store 15 and that is operated via a drive 45. The material web 13 is guided via one or more deflection rollers 57, two by way of example here, through an opening 27 into a loop store 17. This introduction of the material web 13 into the loop store 17 via a deflection roller 57 prevents possible damage to the material web 13 on the entry into the loop store 17. Alternatively to the guidance via a deflection roller 57, the material web 13 can also be introduced over a rounded edge to keep the load on the material web 13 as small as possible.

The material web 13 there forms a loop 19 in the reception space 18 that is formed by the support 23 and the boundary 25 and extends in the longitudinal direction from the opening 27 up to the end 29. A loop portion 20 at the incoming side (cf. FIG. 2) extends in the embodiment shown along the boundary 25, while a loop portion 21 at the outgoing side (cf. FIG. 2) is guided lying on the support 23. Different loop sizes of the loop 19 in the reception space 18 are possible, with two possible loop sizes being shown by way of example here by a loop 19 shown by a solid line and a loop 19 shown by a dashed line.

A plurality of suction apertures 35 via which the reception space 18 communicates with a vacuum source 33 are attached in the lower part of the support 23 in the embodiment shown. Provision can alternatively also be made to attach the suction apertures 35 in a rear wall forming the end 29 of the reception space 18. A suction zone 31 is produced by means of the vacuum source 33 in the lower part of the reception space 18 by which the loop formation can take place in a controlled manner and a desired size of the loop 19 can in particular be achieved.

As already mentioned in the introductory part, provision can also be made to produce the suction zone 31 of every track in a multi-track operation of the interleaver with the aid of a common vacuum source 33, with it preferably being able to develop the same suction effect for each suction zone 31 (cf. also FIG. 3).

In the upper part of the support 23, one or more sensors 41, two by way of example here, are located that can e.g. be configured as contact sensors or vacuum sensors. These sensors 41 permit a measure for the size of the loop 19 to be determined. Sensors 41 designed as contact sensors here react to a contact with the loop portion 21 at the outgoing side and can, for example, be capacitively, inductively, electromechanically, and/or electrostatically active. Sensors 41 designed as vacuum sensors register a vacuum that is produced when the loop portion 21 of the loop 19 at the outgoing side is disposed above the region covered by the sensor 41. Such a vacuum measurement can be carried out particularly advantageously when the support 23 is formed as air permeable, e.g. is provided with suction apertures 35, and communicates with a vacuum source or in particular with the vacuum source 33 shown here that produces the suction zone 31.

The information on the size of the loop 19 acquired by the sensors 41 is sent to a control device 43 that allows the drive 45 of the removal device 11, the motor 55 of the conveying device 61, and the drive 49 of the cutting blade 47 to be coordinated. The conveying device 61 into which the web is here guided via a further deflection roller 57, but can also be guided via a plurality of deflection rollers 57, consists in the embodiment shown of a feed roll 51 and of a contact roller 53 and serves for the highly dynamic feed of the material web 13 into the cutting zone 59.

The size of the loop 19 in the loop store 17 acting as the non-sluggish material store can be adapted by means of the control device 43 to the respective requirement for interleaving sheet material in the cutting zone 59. Provision can, for example, be made here to actuate the drive 45 of the removal device 11 as soon as the size of the loop 19 falls below a defined minimal value and to stop it when a defined maximum size of the loop 19 is registered. Provision can furthermore be made to form the loop 19 with a predefined desired size in the loop store 17 before the start of the feed of the material web 19 into the cutting zone 59, with this desired size being able to be calculated e.g. from the cutting speed and the sheet length and preferably being calculated automatically by the control device 43.

A possible embodiment of a loop store 17 of an interleaves in accordance with the invention is shown schematically in FIG. 2, with the loop store 17 being designed in box shape in this example. This box-shaped loop store 17 provides a reception space 18 that is formed by the support 23 forming a base here and by the boundary 25 formed as a cover and is connected to its end 29 by a rear wall. The boundary 25 is provided at its free end with a rounded deflection edge 26 for the material web 13. The reception space 18 is also laterally closed by side walls not shown here (cf. FIG. 3). As FIG. 2 shows, the support 23 and the boundary 25 do not have to be of equal length, with this nevertheless being possible (cf. FIG. 1). The boundary 25 can be set back with respect to the end of the support 23 at the outgoing side. The inner sides of the reception space 18 provided by the support 23 and the boundary 25 are planar surfaces in this embodiment.

The material web 13 is guided in the reception space 18 and forms a loop 19, with the loop portion 20 at the incoming side extending freely here and the loop portion 21 at the outgoing side extending lying on the support 23.

The boundary 25 is transparent in an advantageous manner in this embodiment and is e.g. manufactured from antistatic plexiglass. This permits a simple optical monitoring of the loop formation during the operation of the interleaves.

One or more suction apertures 35, four by way of example here, through which the support 23 communicates with a vacuum source 33 are located in the lower part of the support 23. This vacuum source 33 produces a suction zone 31 in the reception space 18 and permits the formation of the loop 19 to be monitored and controlled. It is advantageous for the formation of the suction zone 31 if the reception region 18 is closed by the support 23, the end 29, and the boundary 25, as well as by the side walls not shown here, with no absolute gas tightness of the reception space 18 being required.

A plurality of sensors 41 are integrated in the support 23 that are here designed as vacuum sensors and communicate with a vacuum source 33, but can generally also act in a different manner. These sensors 41 register a vacuum that is produced when the loop portion 21 of the loop 19 at the outgoing side is disposed on the region of the support 23 covered by the sensor 41.

A measure for the size of the loop 19 in the reception space 18 is determined by means of the sensors 41 and is sent to the control device 43 that coordinates the removal of the material web 13 and its feed and the cutting off of the products. The removal apparatus, not shown, of the material web 13 can thereby e.g. be caused to convey the material web 13 faster into the loop store 17 when the loop 19 falls below a defined minimal size or to stop the removal of the material web 13 when the loop 19 has reached a defined maximum size. In addition, the size of the loop 19 can e.g. be brought to a specific desired size that can e.g. result from the cutting speed and the sheet length and is preferably calculated automatically by the control device 43 before the start of the feed of the material web 13 into the cutting zone, not shown.

Further suction apertures 35 via which the surface 39 at the outgoing side communicates with a vacuum source 33 are formed in a surface 39 of the support 23 at the outgoing side in the upper part of the support 23, that is the part at the opening side. The loop portion 21 at the outgoing side can be sucked toward the surface 39 at the outgoing side by means of these suction apertures 35 and the vacuum source 33 so that a braking effect on the material web 13 is produced. The vacuum source 33 having the surface 39 at the outgoing side and the suction apertures 35 thus form a braking device 37 that ensures that the material web 13 is always tensioned on the feed into the cutting zone and forces arising during the feed are transferred in a controlled manner to the material web 13.

It can be particularly advantageous to arrange the vacuum sources 33 for forming the suction zone 31, for operating the vacuum sensors 41, and for providing the braking apparatus 37 not as shown here as separate vacuum sources 33, but rather to produce these effects by a single common vacuum source 33. This makes possible a simple and space saving installation and can furthermore reduce the production costs by minimizing the components required.

FIG. 3 shows a view from above of a multi-track loop store 17 through the boundary 25 advantageously designed as transparent here. In this respect, the loop store 17 is divided by the web-like dividing members 30 into four separate reception spaces 18, with the material webs 13 of an interleaver operated with multiple tracks and individual tracks respectively forming a loop 19 in a respective one of the four reception spaces 18. In this respect, the material webs 13 enter into the reception spaces 18 through the opening 27, with the maximum loop length being defined by the end 29 of the loop store.

The dividing members 30 are each displaceable in the transverse direction, i.e. in the direction of the double arrows, so that the loop store 17 can be adapted to differently wide material webs 13 and/or to specific track locations or track arrangements and can be quickly converted to a new application. Different tracks could thus also be fitted with material webs 13 of different widths. The width of the provided interleaver material can thus be adapted to the demands of the product processed in the respective track, in particular to its slice size, and products of different sizes and shapes can be simultaneously supplied with suitable interleaver material.

It is also possible by the dividing members 30 to convert the loop store 17 in a simple manner to the respectively required number of tracks in that e.g. an outer dividing member 30 is simply shifted outwardly toward the respective side wall 32 and is thus so-to-say moved into a "parked position". The remaining dividing members 30 can then be positioned in accordance with the respective application.

Suction apertures 35 via which the reception spaces communicate with a vacuum source, not shown, that produces a respective suction zone 31 in the reception spaces 18 are located in the lower region of the reception spaces 18. The formation of the loops 19 in the reception spaces 18 can be monitored and controlled by means of this vacuum source, with it being able to be sufficient to form the respective suction zones 31 by means of a single vacuum source that produces the same nominal suction effect in each suction zone 31.

The loop store 17 shown in FIG. 2 can be formed with multiple tracks in the manner described in connection with FIG. 3 here.

FIGS. 4 and 5 show further possible embodiments of a loop store 17 of an interleaver in accordance with the invention. They can be used in dependence on the demand, in particular with respect to the available space. In this respect, the embodiments shown here should only illustrate possible aspects and orientations of the loop store, with other designs also being able to be conceivable and not thereby being precluded.

The loop store 17 is oriented in FIG. 4 such that the loop portion 20 at the incoming side of the incoming material web 13, that forms a loop 19 in the loop store 17, lies on the support 23 and the loop portion 21 at the outgoing side only contacts the boundary 25. In this respect, the guidance of the material web 13 shown by a solid line and the guidance of the material web 13 shown by a dashed line show possible extents into and out of the loop store 17 that can be variable, in particular in view of the available space and the respective arrangement of the interleaver and slicer relative to one another and of the path of the material web 13 thereby resulting.

FIG. 5 shows an embodiment in which the material web 13 is guided into the reception space 18 through a slit 63 in the boundary 25 to form a loop 19. The loop portion 21 at the outgoing side that here extends lying over the support 23 exits the reception space 18 here through the opening 27 that is arranged at a height different from that of the slit 63.

These different heights of the inlet of the material web 13 into the loop store 17 and of its outlet can in turn be preferred in view of the respective space available. In this respect, different relations between the heights of the inlet and of the outlet of the material web 13 can be provided; the inlet of the material web 13 into the loop store 17 can in particular also be higher than the opening 27 through which the material web 13 exits. Different orientations of the loop store 17 and different guides of the material web 13, as shown by way of example in FIG. 4, can furthermore be provided.

REFERENCE NUMERAL LIST

11 removal device
13 material web
15 material store
17 loop store
18 reception space
19 loop
20 loop portion at the incoming side
21 loop portion at the outgoing side
23 support
25 boundary
26 deflection edge
27 opening
29 end
30 dividing member
31 suction zone
32 side wall
33 vacuum source
35 suction aperture
37 braking apparatus
39 surface at the outgoing side
40 device for determining a measure for the loop size
41 sensor
43 control device
45 drive of the removal device
47 cutting blade
49 drive of the cutting blade
51 feed roller
53 contact roller
55 motor
57 deflection roller
59 cutting zone
61 conveying device
63 slit

The invention claimed is:

1. An apparatus for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for the one of the first loop portion and the second loop portion and whose side opposite the support forms a boundary for the respective other of the first loop portion and the second loop portion, wherein the reception space is formed with multiple tracks.

2. The apparatus in accordance with claim 1, wherein the reception space has an opening at least for the outlet of the second loop portion at the outgoing side and an end disposed lower than the opening; and wherein a plane extending through the opening and the end extends at an inclination with respect to the horizontal.

3. The apparatus in accordance with claim 1, wherein the support provides a planar support surface for the one loop portion of the first loop portion and the second loop portion; and/or wherein the boundary provides a planar contact surface for the respective other loop portion of the first loop portion and the second loop portion.

4. The apparatus in accordance with claim 1, wherein the support and the boundary extend at least approximately in parallel with one another in the longitudinal direction of the reception space.

5. The apparatus in accordance with claim 1, wherein the spacing between the support and the boundary at a respective position in the longitudinal direction of the reception space defines a clearance of the reception space; and wherein the ratio between the smallest clearance of the reception space and the greatest clearance of the reception space is greater than 0.8.

6. The apparatus in accordance with claim 1, wherein the spacing between the support and the boundary at a respective position in the longitudinal direction of the reception space defines a clearance of the reception space; and wherein the ratio between the greatest clearance of the reception space and the length of the reception space effective for the loop formation amounts to less than 0.5 or less than 0.3 or less than 0.1.

7. The apparatus in accordance with claim 1, wherein the reception space is closed at at least one side.

8. The apparatus in accordance with claim 1, wherein the reception space has a suction zone for the loop that communicates with a vacuum source to act on an outer side of the loop in the sense of a loop size increase.

9. The apparatus in accordance with claim 8, wherein one or more suction apertures opening into the suction zone are provided in least one side of the reception space, via which suction apertures the vacuum source communicates with the suction zone.

10. The apparatus in accordance with claim 1, wherein a braking apparatus for the material web is integrated into the loop store.

11. The apparatus in accordance with claim 10, wherein the braking apparatus comprises a surface of the reception space at the outgoing side.

12. The apparatus in accordance with claim 1, wherein the surface at the outgoing side is formed as air permeable.

13. The apparatus in accordance with claim 12, wherein the surface at the outgoing side communicates with a vacuum source.

14. The apparatus in accordance with claim 1, wherein the loop store comprises a device for determining a measure for the size of the loop in the loop store.

15. The apparatus in accordance with claim 14, wherein the device comprises at least one sensor that acts at a surface of the reception space at the outgoing side or at the incoming side.

16. An apparatus for the single-track or multi-track slicing of food products, the apparatus comprising:

a product feed that supplies products to be sliced on one track or on multiple tracks to a cutting zone in which a cutting blade moves in a rotating and/or revolving manner to cut the supplied products into slices; and an apparatus for providing web-like interleaving sheet material for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for one of the first loop portion and the second loop portion and whose side opposite the support forms a boundary for the respective other of the first loop portion, wherein the reception space is formed with multiple tracks.

17. An apparatus for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for one of the first loop portion and the second loop portion and whose side opposite the support forms a boundary for the respective other of the first loop portion and the second loop portion, wherein the reception space is formed with multiple tracks, wherein the reception space includes at least one dividing member extending in the longitudinal direction of the reception space to separate loops of material webs introduced on multiple tracks from one another, and wherein the at least one dividing member is adjustable in the transverse direction.

18. An apparatus for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for one of the first loop portion and the second loop portion and whose side opposite the support forms a boundary for the respective other of the first loop portion and the second loop portion, wherein the reception space is formed with multiple tracks; and wherein at least two tracks have a suction zone for the respective loop and communicate with a common vacuum source to act on an outer side of a respective loop in the sense of a loop size increase.

19. An apparatus for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for one of the first loop portion and the second loop portion and whose side opposite the support forms a boundary for the respective other of the first loop portion and the second loop portion, wherein the reception space comprises lateral guides for the loop.

20. An apparatus for a single-track or multi-track providing of web-like interleaving sheet material at a cutting zone in which products supplied on one track or on multiple tracks are cut into slices and interleaving sheets are introduced that are cut off from the provided interleaving sheet material in the cutting zone, the apparatus having a removal device that is configured for a removal of the material web from a material store and having a loop store in which the material web forms a loop, the loop having a first loop portion at an incoming side of the loop store and a second loop portion at an outgoing side of the loop store, wherein the loop store comprises a reception space for the loop whose one side forms a support for one of the first loop portion and the second loop portion and whose side opposite the support forms a boundary for the respective other of the first loop portion and the second loop portion, wherein the boundary is formed by a removable cover.

* * * * *